US006688205B1

(12) United States Patent
Petitjean

(10) Patent No.: US 6,688,205 B1
(45) Date of Patent: Feb. 10, 2004

(54) HIGH SPEED CUTTING ASSEMBLY

(75) Inventor: Gilles Petitjean, Arlon (BE)

(73) Assignee: Du Pont Teijin Films UK, Ltd., Cleveland (GB)

( * ) Notice: Subject to any disclaimer, the term of this patent is extended or adjusted under 35 U.S.C. 154(b) by 0 days.

(21) Appl. No.: 09/601,925

(22) PCT Filed: Feb. 5, 1999

(86) PCT No.: PCT/EP99/00757

§ 371 (c)(1),
(2), (4) Date: Sep. 19, 2000

(87) PCT Pub. No.: WO99/41176

PCT Pub. Date: Aug. 19, 1999

(30) Foreign Application Priority Data

Feb. 10, 1998 (EP) ..... 98400295

(51) Int. Cl.[7] ..... B26D 7/28; B26D 7/14; B65H 35/08

(52) U.S. Cl. ..... 83/639.1; 83/175; 83/425; 83/949; 242/527

(58) Field of Search ..... 83/175, 176, 949, 83/639.4, 639.1, 698.42, 698.51, 425–435.16; 242/562, 523.1, 527, 527.7

(56) References Cited

U.S. PATENT DOCUMENTS 3,188,846 A * 6/1965 Fugassi ..... 83/176
3,256,760 A * 6/1966 Vaero ..... 83/176
3,600,995 A * 8/1971 Hanni ..... 83/157
4,182,208 A * 1/1980 Bruno et al. ..... 83/118
4,331,053 A * 5/1982 Imai et al. ..... 493/355
4,408,727 A * 10/1983 Dropczynski ..... 242/521
4,488,466 A * 12/1984 Jones ..... 83/175
4,563,854 A * 1/1986 Ackermann et al. ..... 53/118
4,767,482 A * 8/1988 Diez et al. ..... 83/175
4,922,774 A * 5/1990 Oldeman ..... 83/175
5,086,986 A * 2/1992 Twente ..... 242/527.2
5,150,647 A * 9/1992 Mohr ..... 100/210
5,524,844 A * 6/1996 McCormick et al. ..... 242/553
5,823,083 A * 10/1998 Obertegger et al. ..... 83/175
5,971,083 A * 10/1999 Wiklund ..... 173/19
6,105,478 A * 8/2000 Cestonaro et al. ..... 83/175
6,173,636 B1 * 1/2001 Madrzak et al. ..... 83/949

* cited by examiner

*Primary Examiner*—Allan N. Shoap
*Assistant Examiner*—Isaac Hamilton

(57) ABSTRACT

The invention relates to a cutting assembly for use in thin and ultrathin web winding stations. It also relates to a method for cutting a web using this cutting assembly. According to the invention, the web (1) is cut by a blade (30) with a cutting edge transverse to the web transfer direction; the blade moves between a rearward position and a forward position; in the forward position, the cutting edge is substantially parallel to an axis of the roll (7) receiving the web, and the blade is substantially tangent to a surface of the roll. For cutting the web, the blade is moved from its rearward position to its forward position, so that its speed at the time it engages with said web is at least substantially equal to the speed of the web. This ensures a clean and clear cut of the web. At the same time, it ensures that the leading edge of the web is smoothly and evenly placed on the roll, without any creasing nor folding of the web.

15 Claims, 5 Drawing Sheets

HIGH SPEED CUTTING ASSEMBLY

FIELD OF THE INVENTION

The invention relates in general to cutting knives and methods, and notably to the field of cutting knives and method for webs, and particularly plastic webs such as polyester, polyethylene, PET (polyethylene terephthalate) or PEN (polyethylene naphthalate) webs.

BACKGROUND OF THE INVENTION

The manufacture of thin webs of plastic material such as polyester involves different operations to be performed on the webs, such as stretching of the webs, winding up of the webs on rolls, etc. It is also necessary to cut the webs, e.g. after a roll of a given size has been wound up. This causes several problems. The first problem is the actual cutting of the webs. The second problem is to deal with the leading edge and the trailing edge created through the cutting of the web. The third problem is to protect the core around which the web is supposed to be wound, since this core is supposed to be used several times. Ideally, a good cutting solution for webs and particularly plastic webs, should provide a clear and accurate cutting, and should allow the leading edge of the web after the web to be wound up easily, without stopping the web or slowing the speed of the web, and without any crease or fold in the web.

One type of solution for cutting such a web, while it is being wound up, it to use a knife moving transverse of the web winding direction or longitudinal axis of the web, that is along the axial direction of the rolls. Such a cutting apparatus is for instance described in U.S. Pat. No. 4,637,567, or in EP-A-0 606 662. The first of these documents discloses a knife formed of a flat blade having a flat surface, that moves transverse of the web longitudinal direction. The flat surface of the knife is brought into contact with the surface of the roll on which the web is to be wound; this contact avoids any crease or fold in the web as it is being cut. In addition, to ensure that the web fits on the new roll, the web may be moistened before it reaches the roll. EP-A-0 606 662 discloses a rotary cutting knife that travels along the axial direction of the roll.

For such knives moving along the axial direction of the rolls, the leading and trailing edges of the web are generally not perpendicular to the longitudinal axis of the web. Since the web to be cut travels along its winding direction, with a speed that can reach 450 m/min (7,5 m/s), the usual angle between the web edge and the longitudinal axis of the web may be quite high, even if the knife moves at a comparable speed. EP-A-0 606 662 exemplifies a knife moving at a speed of 600 m/min, and an angle of the leading edge of the web around 40°. This causes loss of web at the beginning and end of each roll, or more generally, each time the web is cut. The amount of web lost may be up to several percents. It also makes the handling of the web more difficult for subsequent operations, due to the triangular shape of the end of the web, and thus the final conical shape of the wound up roll. Moreover, the winding up of the web on the winding roll is made more difficult since the triangle-shaped leading edge causes an asymmetrical profile on the core of the roll. Finally, such knives have to move at high speed, and should be accelerated and decelerated over short distances, so as to limit the bulkiness of the apparatus. This creates mechanical problems.

Another type of solution uses a knife with a cutting edge extending transverse of the web, that is reciprocated along the web winding direction to cut the web. U.S. Pat.No. 5,464,166 discloses a rotary cut-off knife assembly, having a cylindrical cut-off roll with a knife along one generating line of the roll; the knife may project out of the roll or be retracted. The operation of this device is the following: the cut-off roll is brought into contact with the web, with the knife retracted in the roll, and the knife is projected outside of the roll when the web is to be cut. In this document, it is suggested that the linear speed of the cut-off roll is higher than the travel speed of the web, and is typically 25% greater than the speed of the web. In order to bring the leading edge of the web to the core of the new roll, this document suggest cutting the web in the neighbourhood of the core roll, while generating an electrostatic charge on the core roll. For this purpose, it is suggested that the gap between the tip of the knife and the core roll be about 1.5 mm when the knife severs the web. The solution suggested in this document ensures that the web is cut transverse to the winding direction. However, accelerating the cut-off roll at a speed higher than the one of the web may cause a problem, especially for very thin webs wound at high speeds; indeed, before the web is severed, the cut-off roll is in contact with the web and rotates at a higher speed. Moreover, there is a wedge of air between the web and the core roll at the time the web is cut. The presence of air creates creases or folds and makes it difficult to ensure that the leading edge of the web is smoothly and evenly placed on the core. Finally, it would be advantageous to avoid using an electrostatic charge system.

U.S. Pat. No. 4,789,109 uses a blade powered by a compressed air box for cutting a web transverse its winding direction. In this document, it is suggested to incorporate the blade and its air box to a pusher device for rotating a completely wound web out of the winding device. The winding of the web must however be stopped for cutting the web and getting the wound roll out of the winding apparatus. The new core roll is provided with a glue stripe or with a 2-sided tape, and is lowered over the leading edge of the web. This device is highly disadvantageous in that it implies stopping web supply each time a new roll must be started.

Other types of cutting apparatuses have been suggested; U.S. Pat. No. 5,335,869 discloses a blade entering into a recess of a roll; U.S. Pat. No. 5,285,977 discloses a similar system where projections of one roll enter into recesses on another roll. These systems cannot cut the web directly in the neighbourhood of the core of a roll, and propose complicated solutions for bringing the leading edge of the web to the core of the roll where it should be wound. U.S. Pat. No. 3,047,248 discloses a reciprocating knife, mounted on oil pressure actuators, in a cloth winding circuit.

To summarise, none of the various solutions of the prior art provides a cutting apparatus that may be used for the cutting of thin and ultra thin webs in a winding station, while ensuring:

- a clean cut transverse the winding direction of the web;
- a smooth and even placing of the leading edge of the web on a new core roll, without any need to stop supplying the web to the station.

SUMMARY OF THE INVENTION

Accordingly, the purpose of the invention is to provide a solution that overcomes the problems of the prior art. According to the invention, there is provided a high speed knife moving along the web direction, tangent to the web and adjacent the core of the new roll, so as to ensure a clean and clear cut of the web, and at the same time, a smooth and even placing of the leading edge on the core roll.

The invention proposes a cutting assembly, comprising an elongate housing at least two guiding shafts transverse to the housing and slidingly supporting a blade through at least one carriage; said at least one carriage being movable between a rearward position and a forward position; actuating means for displacing said at least one carriage from the rearward position to the forward position; holding means for holding said at least one carriage in its rearward position and for releasing said at least one carriage from its rearward position to the forward position. Prefereably, the blade is a flexible blade.

The actuating means may be operated by a pressurised fluid, preferably pressurised air. They may comprise at least one cylinder with a piston connected to one carriage. The holding means advantageously comprise at least one trigger engaging a protruding section of said at least one carriage, and releasing means for disengaging said trigger from said protruding section. The releasing means may also be operated by a pressurised fluid, preferably pressurised air. They preferably comprise an inflatable tube capable of displacing said trigger when inflated.

The assembly may also comprise return means for bringing said at least one carriage from its forward position to its rearward position, or elastic means for receiving said at least one carriage when it reaches its forward position.

Prefereably, the cutting assembly further comprises a nose part mounted on said housing, near to said forward position. The nose part may be an elastic part. The assembly may also comprise a flexible plate mounted on the lower side of said housing, near to said forward position, and adapted to tangentially receive the blade when the blade is in its forward position.

The invention also relates to a web winding apparatus, comprising at least a roll and a cutting assembly located near a roll, said cutting assembly having a blade movable between a forward position and a backward position, wherein, in the forward position of the blade, a cutting edge of the blade is substantially parallel to an axis of the roll while the blade is substantially tangent to a surface of the roll.

Preferably, the apparatus further comprises a transfer roll, the roll is a winding roll, and the cutting edge of the blade in its forward position lies near the nip point between the winding roll and the transfer roll. The angle between the blade and a plane tangent to the roll at the contact line of the blade with the roll is preferably between 0° and 10°.

The invention finally relates to a process for cutting a thin web in a thin web winding station, comprising a roll receiving the web; a cutting assembly having a blade with a cutting edge, said blade being movable between a rearward position and a forward position where the cutting edge is substantially parallel to an axis of the roll and where the blade is substantially tangent to a surface of the roll, the process comprising the step of moving said blade from its rearward position so that its speed at the time it engages with said web is at least substantially equal to the speed of the web.

Preferably, the process comprises the step of further accelerating said blade after it engages with said web. The cutting assembly is advantageously at a location near the nip point between the transfer roll and the winding roll.

BRIEF DESCRIPTION OF THE INVENTION

A cutting apparatus embodying the invention will now be described, by way of non-limiting example, with reference to the accompanying drawings, in which.

BEST MODE OF CARRYING OUT THE INVENTION

Figure 1:
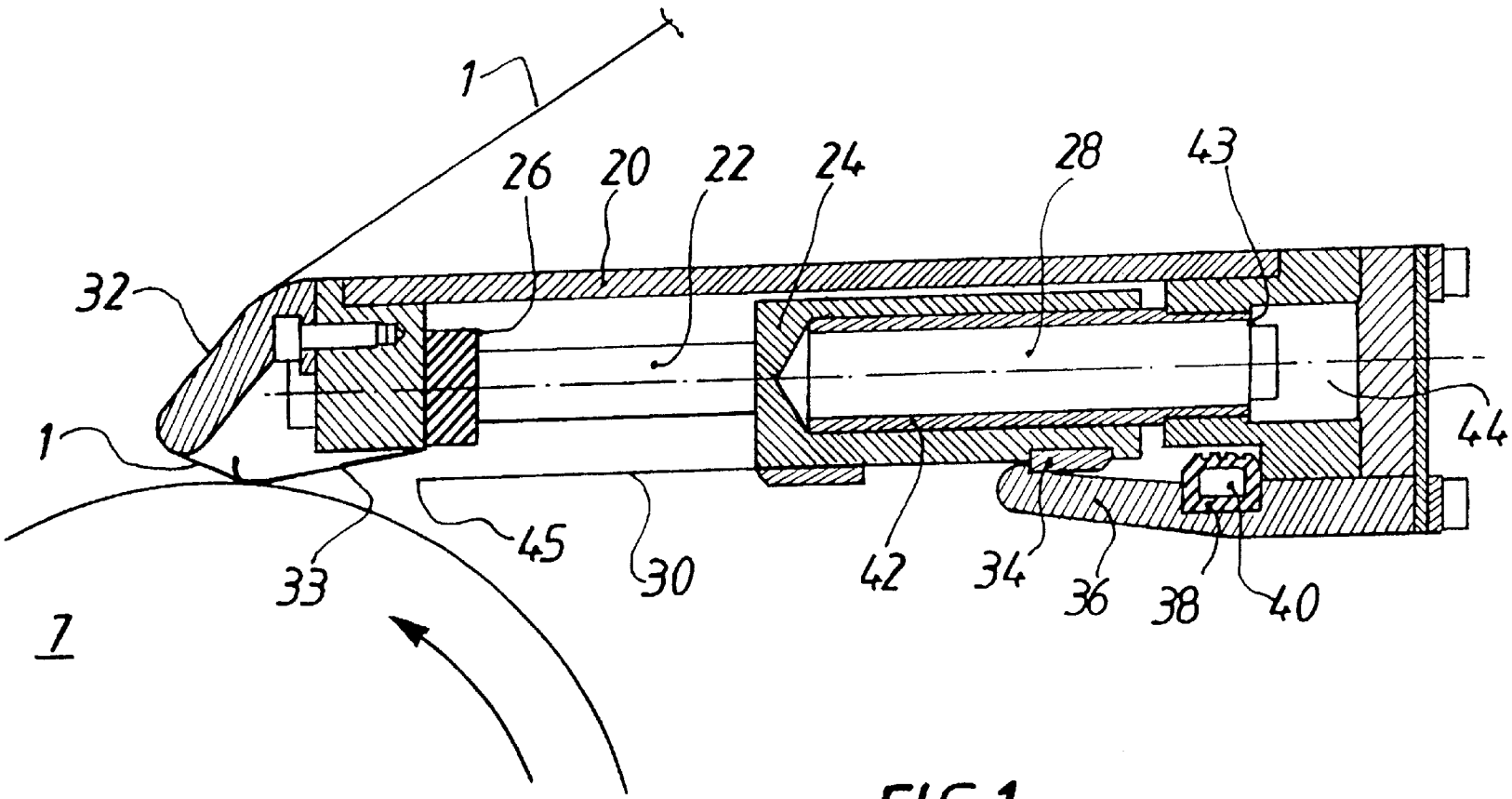
FIG. 1 is a schematic cross-sectional side view of a cutting assembly according to the invention, in the rearward position.

FIG. 1 is a schematic view of a cutting assembly according to the invention. The structure and operation of the cutting assembly will be discussed first in reference to FIGS. 1 and 2, before explaining the possible use of this assembly.

The cutting assembly comprises a housing 20 (represented here open on its lower side); a plurality of guiding shafts 22, mounted in the housing, and spaced along the length of the housing, each shaft having an longitudinal axis transverse the length of the housing; a carriage 24 slidingly mounted on the guiding shafts, and capable of moving along the guiding shafts 22 between a rearward position and a forward position, in which it abuts against elastic means 26 surrounding one end of the shafts 22; actuating means 28 mounted in the housing 20 and engaging the carriage 24 and being able to move the carriage 24 from its rearward position towards its forward position; a blade 30 mounted on the outer side of the carriage 24 facing the roll, and protruding from the carriage, in a direction substantially parallel to the axis of the guiding shafts 22. The cutting assembly further comprises a front elastic part or nose 32 mounted along the length of the housing, on a side of the housing nearer to the forward position of the carriage, that is nearer to one end of the guiding shafts 22. The nose 32 has the shape of a lip; fixed to the upper front edge of the housing and forming an angle of e.g. around 45° with the axis guiding shaft; the nose extends substantially as low as the lower edge of the housing. A flexible plate 33 is located below the nose 32 and is adapted to receive the blade 30 during the last part of its displacement, said plate being so that the blade 30 will be moving tangent to said flexible plate 33 when the carriage 24 reaches its forward position.

Figure 2:
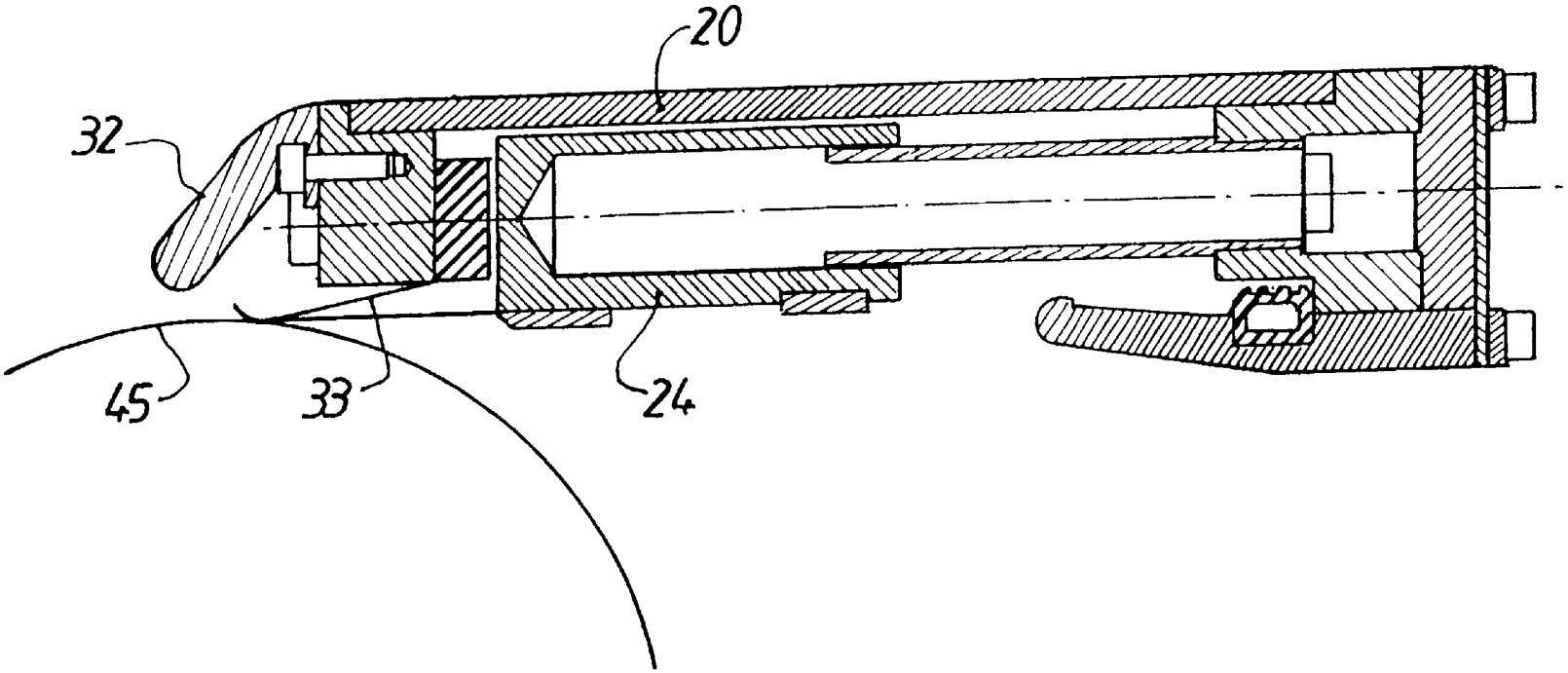
FIG. 2 is a schematic cross-sectional side view of a cutting assembly according to the invention, in the forward position.

The carriage 24 has a protruding section 34 engaging a trigger 36 of the housing; the trigger 36 may release the protruding section 34, due to operation of releasing means 38. In the embodiment of FIG. 2, the releasing means 38 are formed of an inflatable tube 40 extending along the length of the housing, and adapted to deform the trigger 36 when inflated. The actuating means 28 comprise a plurality of cylinders 42, that are connected to a pressurised air source (not represented on the drawings), through a common channel 44extending along the cutting assembly. In each of these cylinders 42 is mounted a piston 43 connected between the carriage 24 and the housing 20. The cutting assembly also comprises return means for returning the carriage 24 from its forward position; where it abuts against the elastic means 26, to its rearward position, where the protruding section 34 is engaged by the trigger 36. This return means, not represented may similarly comprise cylinders and pistons.

In a preferred embodiment of the invention, the carriage 24 extends on the whole length of the cutting assembly, that is on the whole width of the film to be cut. The carriage provides the necessary stiffness to the blade, that may be a thin and flexible blade, as discussed below. Thus, the invention allows to limit the weight of the moving parts of the cutting assembly, this ensuring that the blade may reach a high speed with a high acceleration. In addition, the light weight of the moving parts lessens the mechanical constraints on the knife assembly.

The operation of the cutting assembly of FIG. 2 is the following. In the rest position, the carriage 24 is in its rearward position, and the pressure in the cylinders 42 and in the releasing means 38 is low, e.g. atmosphere pressure. The protruding section of the carriage 34 is engaged with the trigger 36, so that the carriage 24 is blocked in its rearward position. Pressure in the cylinders 42 of the actuating means 28 may then be increased; the actuating means thus tend to force the carriage from its rearward position to its forward position, that is from right to left on FIG. 1. The carriage 24 is however maintained in its rearward position by the trigger 36, while pressure still increases in the cylinders. This pressure may thus be increased to reach the value necessary for moving the carriage at the required speed, as explained below in reference to FIG. 3. When the necessary pressure is reached, the releasing means 38 are activated, e.g. by inflating the inflatable tube 40. This deforms the trigger 36 so that the protruding section is no longer engaged by the trigger 36; the carriage 24 is released and pushed towards its forward position by the actuating means 28, that is by the pressure of the air in the cylinders 42 and pistons 43. Thus the blade 30 is moved, parallel to the axis of the guiding shafts 22, till it reaches it forward position.

The trigger system of the cutting assembly of FIG. 1 ensures that the carriage 24 is released on its whole length at the same time, thus limiting or avoiding deformations of the carriage. In one embodiment of the invention, the cutting assembly of FIG. 1 comprises shafts every 0.20 m, and comprises 5 cylinders between each pair of adjacent shafts. Such a structure ensures on the one hand a sufficient stiffness of the carriage, and on the other hand, provides the pneumatic force necessary for accelerating the blade.

The forward position of the blade and carriage is represented on FIG. 2. The carriage 24 abuts against the elastic means 26, when reaching the forward position. The blade, at that time, had passed beyond the flexible plate 33 and the cutting edge of the blade lies about underneath the end of the nose 32. Pressure in the cylinders is reset to zero from external means such as a two way valve, that are activated after the cutting operation, e.g. 1 second or so after the cutting operation. The pressure in the inflatable tube 40 may also be caused to decrease. The return means may then be operated to bring the carriage 24 back to its rearward position; when the carriage 24 is brought back the rearward position, the trigger engages again the protruding section of the carriage. The cutting assembly may then be operated again for another movement of the blade 30.

The cutting assembly according to the invention provides a reliable, fast and precise movement of the blade 30, with a speed that can be adjusted according to the pressure applied to the cylinders 42 of the operating means. The blade 30 may be of any shape appropriate for performing the cutting. Examples are doctor blade and blade with teeth. Preferably, the blade has a low weight, so that it may be accelerated easily and quickly over a short distance. It may also be flexible, this ensuring full tangential contact of the blade with the roll surface, in spite of small surface irregularities. The fact that the speed, of the knife may be higher than the one of the web to be cut ensures that even a serrated blade will not produce elongated strips of web, but a clean and clear cut.

The cutting method according to the invention is now explained. This method may advantageously be carried out using the cutting assembly described above in reference to FIGS. 1 and 2; it should however be understood that this method may also be carried out using a different assembly. In reference to FIG. 1, the cutting assembly is shown in a position where it is ready to cut a web 1, that is to be wound on a core roll 7. As shown on FIG. 1, roll 7 rotates counter-clockwise. The cutting assembly is located with respect to the web 1 and to the roll 7, so that the blade of the cutting assembly, when released, will contact the web while substantially tangent to the roll 7, at a speed higher than the speed of the web. In the case of the cutting assembly of FIG. 1, the positioning of the cutting assembly is made easier because of the plate 33, that may be brought into contact with the roll 7. While the cutting assembly is brought near to the roll, the web is in contact with the nose 32 of the assembly; this nose ensures that the web travels normally without any risk of tearing. The exact angular position of the web with respect to the nose is not important for the carrying out of the invention. The fact that the web turns around the nose and thus is taken away from the roll helps cutting the web over a relatively short distance.

Preferably, the angle between the blade and the plane tangent to the roll at the contact line of the blade with the roll is between 0° and 10°. A value around 2°, the blade being slightly directed toward the center of the roll, ensures a good cutting of the web, while still protecting the roll.

At the time the web is to be severed, the blade of the cutting assembly is released, and impinges on the web, tangent to the outside surface of the roll, at a speed higher than the speed of the web. This ensures, one the one hand, that the web is severed, with a clean and clear cut. On the other hand, this ensures that the leading edge of the web remains in contact with the roll 7, without any need for specific means such as electrostatic charging means, 2-sided tape or a strip of glue. Since the blade is tangent to the outside of the roll, there is no air trapped between the web and the roll at the time the web is cut. This avoids the problems of the prior art discussed above, and ensures a smooth and even placing of the leading edge on the roll. In addition, since the blade is tangent to the roll and first contacts the web. The roll is not damaged by the cutting of the web, and may be used again later. FIG. 2 shows the cutting assembly and of the roll after the web has been Cut. Reference 45 shows the cutting edge of the blade. The blade 30 lies tangent to the roll 7, with its cutting edge approximately beneath the nose 32.

The invention thus ensures the proper cutting of the web, and at the same time, the proper placing of the leading edge of the web on the roll. As compared to the prior art, it provides a simpler and more efficient solution.

Figure 3:
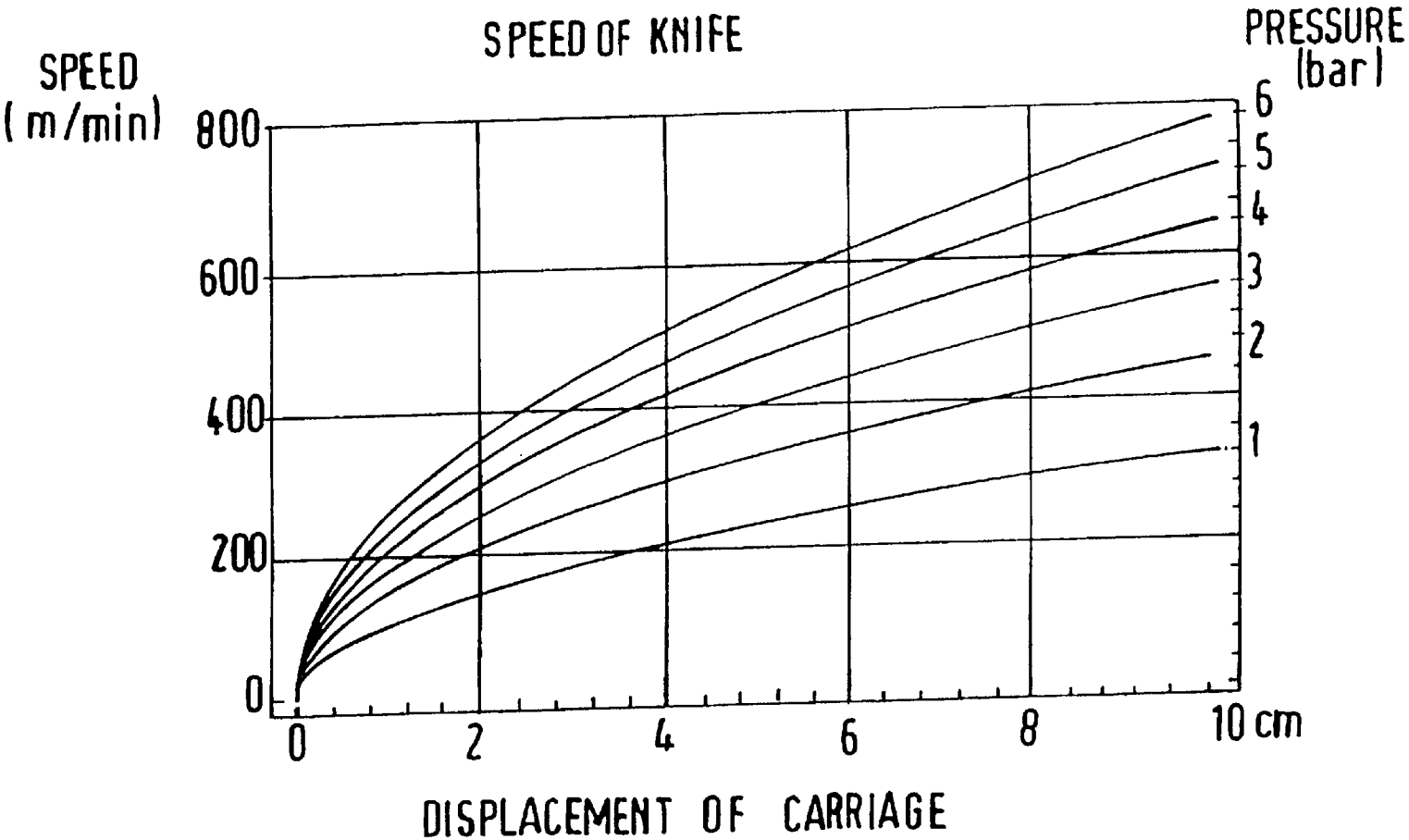
FIG. 3 is a plot of the speed of the knife of a cutting assembly according to the invention, for several actuating pressures.

FIG. 3 is a plot of the speed of the knife of a cutting assembly according to the invention, for several actuating pressures; the vertical axis shows the speed of the blade 30 and carriage 24, measured along the axis of the guiding shafts, from the rearward position to the forward position; in meter per minute. The horizontal axis shows the displacement x of the carriage, from its rearward position, where x=0. The plot of FIG. 3 shows several pressures of the actuating means: lines 51–56 respectively correspond to pressures of 1, 2, 3, 4, 5 and 6 bars (1 bar=0.1 MPa); these pressures are the pressures measured in the actuating means just before the releasing means are actuated. The plots of FIG. 3 show that for a given displacement of the carriage, several speeds of the blade can be obtained, according to the pressure in the actuating means. This makes it possible to set the speed of the front edge of the blade, at the place it should get into contact with the material to be cut. Preferably, this speed is set to be at least as high as the speed of the material to be cut. It is preferably higher by at least 20 m/min than the speed of the web, a value of 40 m/min proving to be appropriate in practise.

Figure 4:
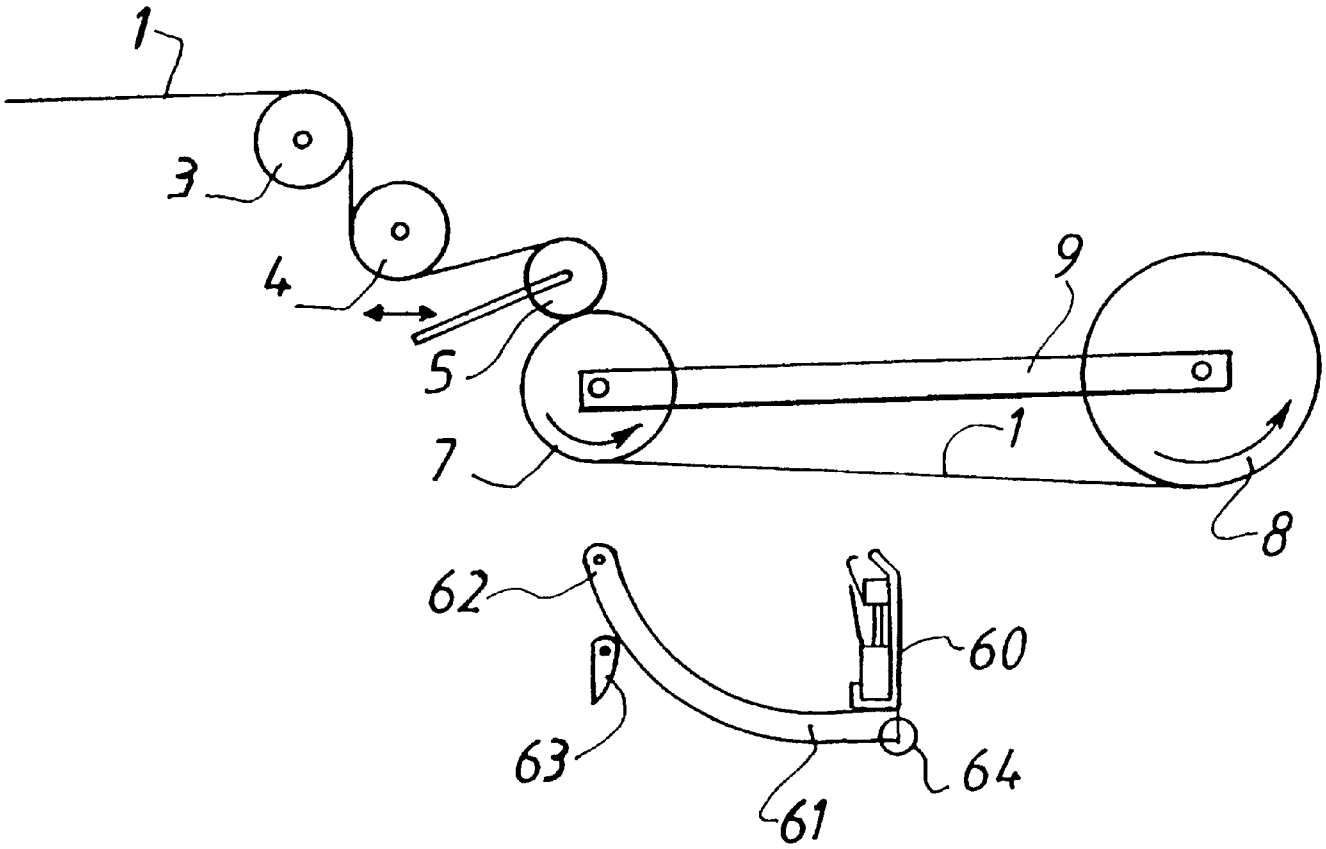
FIG. 4 is a schematic view of a winding apparatus with a cutting assembly according to the invention, in the retracted or stand-by position.

FIG. 4 is a schematic view of a winding apparatus with a cutting assembly according to the invention; the winding apparatus of FIG. 4 is adapted for use in a web production line, such as for instance the one described in FR-A-2 676 427 to the applicant. A web 1 is fed to the winding apparatus, in a manner known per se. The winding apparatus comprises for example several transfer rolls 3, 4 and 5. Two winding rolls 7, 8 are mounted at the ends of a pair of rotating arms 9, one of which only is represented on the figure. The rotating arms are capable of rotating around a shaft 11 located at the middle of the rotating arms. The transfer roll is capable of moving as shown on FIG. 4 by arrow 6, so as to come into contact with one of the winding rolls, or so as to be spaced apart from these rolls.

The winding apparatus of FIG. 4 comprises a cutting assembly of the type described above in reference to FIGS. 1 and 2. This cutting assembly 60 is mounted on the rotatable retractable enveloping arms 61. The cutting assembly is capable of pivoting around an axis 62, and its position may be radially adjusted with respect to the winding roll, e.g. using a motorised cam 63. The apparatus represented in FIG. 4 is in its stand-by or retracted position below the two rolls 7 and 8. The width of the apparatus 60 and arms 61 is adapted to engage between arms 9.

Figure 5:
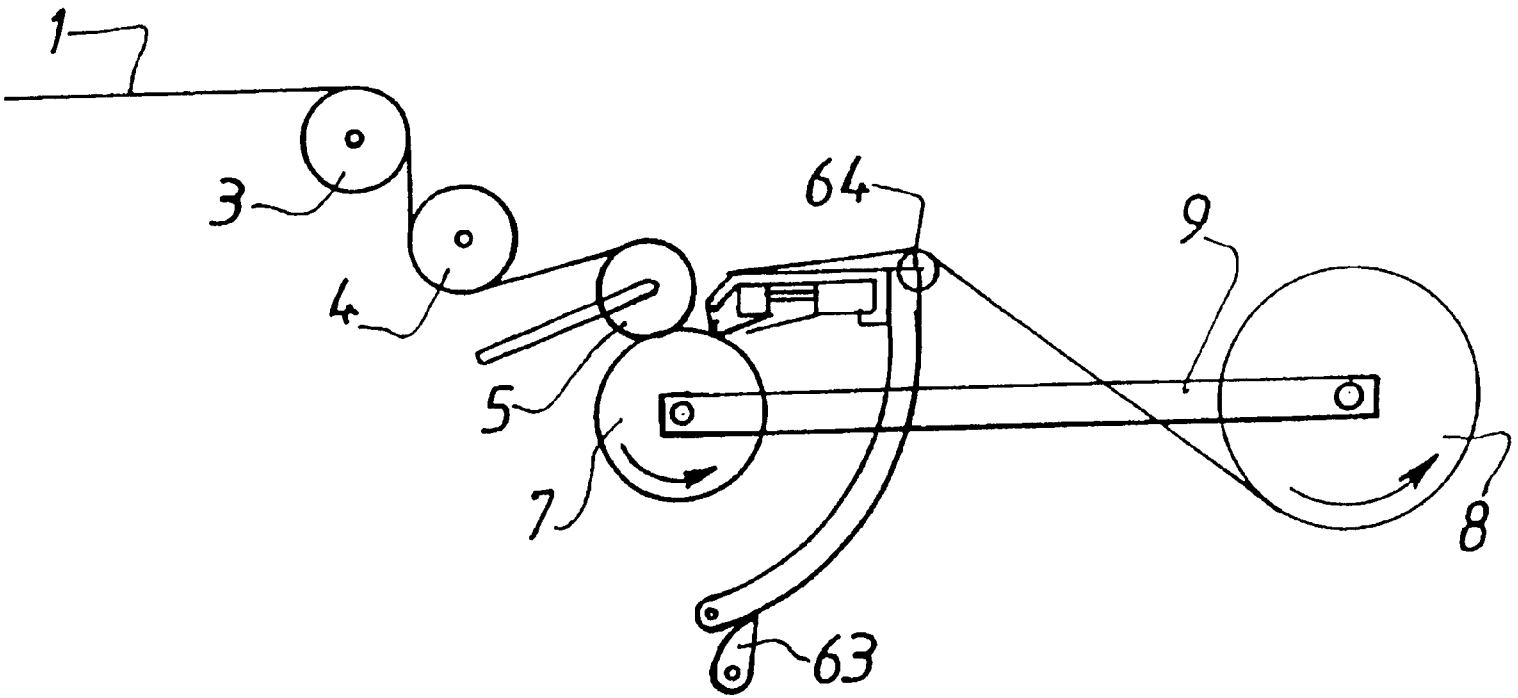
FIG. 5 is a schematic side view of a cutting assembly in its cutting position.

FIG. 5 is a schematic side view of a cutting assembly in its cutting position. In this position the cutting assembly is near to the empty roll to be wound up, so that the blade 30 lies substantially parallel to the web; the front edge of the blade moves in the same direction as the web when the carriage moves from its rearward position to its forward position. The blade is substantially transverse and tangent to the roll 7; preferably, for high speed operation, the roll 5 is covered with elastomeric material and is nipped to the winding roll 7, that is brought into contact with the winding roll. If necessary, an additional small transfer roll 64 may be provided at a position on the rear of said cutting apparatus.

The process for operating the apparatus of the invention is as follows. At the starting point of the process, step -a-, the web is fed from the transfer roll 5 to the first winding roll 8, where it is wound; at that time, the transfer roll 5 may contact the winding roll. At step -b-, when the roll 8 has reached its desired diameter, the transfer roll 5 is retracted and the winding rolls 7 and 8 are rotated counter-clockwise, so that an empty roll 7 comes near to the transfer roll. The roll 5 is then brought into contact with the empty winding roll 7. At that time, the web is fed from the transfer roll 5 to the empty winding roll 7 and then to the winding roll S. This situation is represented on FIG. 4.

At step -c-, the cutting assembly is moved to its cutting position, where the blade of the cutting assembly is substantially transverse and tangent to the web and its underlying winding roll 7. This situation is represented on FIG. 5. In the cutting position, the cutting assembly is located near the nip point between rolls 5 and 7. The position of the cutting assembly in step -c- is also the one represented in FIG. 1 above. Step -c- may easily be carried out by detecting the contact of the plate 33 with the winding roll 7. At the end of said step -c-, the web is engaged by the nose 32 and flexible plate 33 of the cutting apparatus. The web is thus deflected around the nose 32 of the cutting assembly, and is transferred from the additional transfer roll 64 of the cutting assembly to the winding roll 8. It should be understood that in this step, the web is still being wound on the winding roll 8, and that it is not necessary to stop the supply of web; if necessary, the winding speed of the winding roll 8 may be adapted while the cutting assembly is moved, inasmuch as this changes the path of the web. The process may then proceeds to step -d- or -e-.

Step -d- is optional and consists in moving the cutting assembly slightly away from the first winding roll 7, e.g. a few mm, typically 1 mm or less. This may he useful to avoid any damage to the roll during the cutting of the web. The process then proceeds to step -e-.

At step -e-, the actuating means of the cutting assembly are pressurised. The pressure is chosen according to the speed of the web at the cutting point, so that the speed of the blade at the time it engages with the web is at least substantially equal to the speed of the web.

At step -f-, the releasing means are operated, so that the blade moves from its rearward position to its forward position. This is represented at FIG. 2, see above. The web is cut by the blade. The cutting is improved if the blade is further accelerated after it engages with said web; the blade may thus continue moving over a slight distance, e.g. 20 mm or so, after the web is cut. Once the web is cut, the trailing edge of the web finishes to wind onto the winding roll 8; once the trailing edge reaches the second winding roll, this roll may be stopped. The cutting apparatus is preferably located close to the nip point between rolls 5 and 7, and optionally since the front edge of the web is driven by the blade which is still accelerating, and is also driven by the roll 7, the web, once it is cut, is by roll 7 to the nip of roll 5. The leading edge of the web is thus smoothly and evenly placed on the roll, and the winding up of the roll may thus be cleanly initiated.

Thereafter, at step -g-, the cutting assembly is brought back to its retracted position; the pressure in the cutting assembly is reset to zero, and the return means bring the blade back to its rearward position, where the trigger engages the carriage. The second winding roll 8 may be then discharged, and a new empty core may be mounted; the cutting assembly is withdrawn to the retracted position of FIG. 4. The process is then ready to proceed again from the starting point discussed above.

The invention was described in reference to a preferred embodiment. Many variations are possible; for instance, the length of the blade can be adapted to the width of the web to be cut. The embodiment of FIGS. 1 and 2 comprises one carriage 24 mounted on the guiding shafts and supporting the blade. There may be more than one carriage, e.g. one carriage on each shaft or between each pair of shafts; there may be one or several adjacent blades. The number of guiding shafts, and carriages depends on the type of blade to be used. The cutting assembly may be used not only in a winding apparatus of the type described with reference to FIGS. 4 and 5, but also in any type of winding apparatus, or more generally, at any point of a web production line.

What is claimed is:

1. A cutting assembly, comprising an elongate housing; at least two guiding shafts having each a longitudinal axis transverse to the housing; a cutting blade mounted on at least one carriage; said at least one carriage being slidingly mounted on the guiding shafts and along the guiding shafts between a rearward position and a forward position for moving the cutting blade parallel to said axis of the guiding shafts; means for actuating and displacing said at least one carriage from the rearward position to the forward position; and means for holding said at least one carriage in its rearward position and for releasing said at least one carriage from its rearward position to the forward position.

2. A cutting assembly according to claim 1, wherein the blade is a flexible blade.

3. A cutting assembly according to claim 1, wherein the actuating means are operated by a pressurized fluid.

4. A cutting assembly according to claim 1, wherein the actuating means comprise at least one cylinder with a piston connected to one carriage.

5. A cutting assembly according to claim 1, wherein the holding means comprise at least one trigger engaging a protruding section of said at least one carriage, and releasing means for disengaging said trigger from said protruding section.

6. A cutting assembly according to claim 5, wherein the releasing means are operated by a pressurized fluid.

7. A cutting assembly according to claim 5, wherein the releasing means comprises an inflatable tube capable of displacing said trigger when inflated.

8. A cutting assembly according to claim 1, further comprising return means for bringing said at least one carriage from its forward position to its rearward position.

9. A cutting assembly according to claim 1, further comprising elastic means for receiving said at least one carriage when it reaches its forward position.

10. A cutting assembly according to claim 1, further comprising a nose part mounted on said housing, near to said forward position.

11. A cutting assembly according to claim 10, wherein said nose part is an elastic part.

12. A cutting assembly according to claim 1, further comprising a flexible plate mounted on the lower side of said housing, near to said forward position, and adapted to tangentially receive the blade when the blade is in its forward position.

13. A cutting assembly according to claim 1, wherein the actuating means are operated by pressurized air.

14. A cutting assembly according to claim 5, wherein the releasing means are operated by pressurized air.

15. A cutting assembly according to claim 12, wherein the cutting blade is extending substantially parallel to said axis of the guiding shafts.

* * * * *